US005496040A

United States Patent [19]

Amburgey et al.

[11] Patent Number: 5,496,040

[45] Date of Patent: Mar. 5, 1996

[54] FOLDABLE SOCCER AND HOCKEY GOAL AND EQUIPMENT SET

[75] Inventors: James D. Amburgey, Richardson; Peter C. Hill, Plano, both of Tex.

[73] Assignee: Today's Kids, Inc., Boonville, Ark.

[21] Appl. No.: 191,960

[22] Filed: Feb. 4, 1994

[51] Int. Cl.[6] ..... A63B 63/00

[52] U.S. Cl. ..... 273/411; 273/127 B

[58] Field of Search ..... 273/26 A, 29 R, 273/30, 181 R, 181 F, 181 K, 127 B, 400, 411, 181

[56] References Cited

U.S. PATENT DOCUMENTS

| | | | |
|---|---|---|---|
| D. 334,886 | 4/1993 | Cortelli et al. . | |
| 2,449,708 | 9/1948 | Lundsay | 273/127 B |
| 3,184,235 | 5/1965 | Hilbrich . | |
| 3,408,071 | 10/1968 | Lundy | 273/26 A |
| 3,475,025 | 10/1969 | Uphaus | 273/26 A |
| 3,698,712 | 10/1972 | Pero . | |
| 3,698,715 | 10/1972 | Browning | 273/127 B |
| 4,083,561 | 4/1978 | Daffer, Jr. | 273/127 B |
| 4,116,446 | 9/1978 | Thompson . | |
| 4,258,923 | 3/1981 | Senoh . | |
| 4,286,786 | 9/1981 | Papadopoulos . | |
| 4,407,507 | 10/1983 | Caruso . | |
| 4,420,158 | 12/1983 | Klock et al. . | |
| 4,786,053 | 11/1988 | Barnes, Jr. . | |
| 4,842,284 | 6/1989 | Rushing et al. . | |
| 4,905,996 | 3/1990 | Tallent et al. . | |
| 5,048,844 | 9/1991 | Haseltine . | |
| 5,080,375 | 1/1992 | Moosavi | 273/400 |
| 5,205,564 | 4/1993 | Lamberti | 273/181 F |

*Primary Examiner*—Theatrice Brown
*Attorney, Agent, or Firm*—Kirkpatrick & Lockhart

[57] ABSTRACT

A foldable soccer and hockey goal and equipment set is disclosed wherein the goal and the equipment can be conveniently transported and stored in one lightweight and self-contained unit. The goal comprises an inclined net holder having a net attached thereto and being supported by first and second approximately right-triangular upright support members which are hingedly attached to the inclined net holder. The support members are made to be hollow and are provided with filler holes to allow filling with a ballasting material, such as sand or water, to provide stability to the goal when in use. In a closed position, hockey sticks can be placed through rungs situated on each support member to maintain the support members in a folded position and to retain a soccer and hockey ball therein.

15 Claims, 13 Drawing Sheets

FOLDABLE SOCCER AND HOCKEY GOAL AND EQUIPMENT SET

BACKGROUND OF THE INVENTION

1. Field of the Invention

The present invention relates to children's toys and amusement devices. More particularly, the present invention relates to equipment for playing soccer or hockey.

2. Description of the Invention's Background

Many different types of goal structures have been developed for playing or practicing soccer and hockey. Many of these goals are designed to be portable, so that the user may carry the goal to a practice site, set up the goal for playing or practicing, and then break down the goal and carry it away when finished playing or practicing. Many of these goals are designed for use by teens or adults, utilizing, for instance, a regulation size soccer ball. As such, the portability of these goals cannot be achieved without breaking apart the frame of the goal in some fashion. For example, U.S. Pat. No. 5,048,844 to Haseltine discloses a portable rebounding soccer training goal, U.S. Pat. No. 4,407,507 to Caruso et al. discloses a portable soccer goal, and U.S. Pat. No. to Thompson discloses a multi-section game net support apparatus. In each of the Haseltine, Caruso et al. and Thompson patents, however, the soccer goal is portable in that it comprises modular tubular frames which break apart for transportation and storage.

Other types of goal structures have been developed for playing or practicing soccer and hockey for use by children. These structures tend to be simply smaller versions of full-size soccer goals. For instance, U.S. Pat. No. 4,258,923 to Senoh discloses a disassemblable football goal structure and U.S. Pat. No. 5,080,375 to Moosavi discloses an adjustable soccer goal assembly. In both the Senoh and Moosavi patents, however, the soccer goal is adjustable in that it comprises modular tubular frames which break apart for transportation and storage.

One problem with making a smaller soccer goal for children's use is that a smaller structure tends to be lightweight, and so the goal would not have the stability required for soccer or hockey. The impact of a soccer or hockey ball, or brushing or jostling by players, will cause such a structure to move out of position. Such structures could be simply made of heavy material, but this would reduce portability. Other portable goal structures have used water as a ballasting medium. U.S. Pat. No. 4,786,053 to Barnes, Jr., discloses a portable freestanding apparatus which can be formed to hold a net and which uses water as a ballasting medium. Barnes, Jr., however, again comprises a modular tubular frame and only breaks down to a limited degree.

It is further noted that none of the above-described structures provides any means for carrying the attendant soccer or hockey equipment—hockey sticks, hockey balls, or soccer balls—along with the structure, thus requiring the portable goal to be carried independently from the equipment. This may necessitate a second trip between the storage area and the playing area. Furthermore, such equipment is often awkward to carry all at once, and thus a bag or other container is required.

In view of the above, it is an object of the present invention to provide a soccer and hockey goal and equipment set which is readily capable of being carried and set up by a child.

It is another object of the present invention to provide an improved soccer and hockey goal and equipment set which is foldable for portability.

A further object of the present invention is to provide a soccer and hockey goal and equipment set which when closed contains all of the equipment necessary to play soccer and hockey.

It is a further object of the present invention to provide a soccer and hockey goal and equipment set which latches in the closed position by use of the hockey sticks provided as part of the apparatus.

Another object of the present invention is to provide a soccer and hockey goal and equipment set that can be stabilized by filling the base with a ballasting material such as sand or water.

SUMMARY OF THE INVENTION

The above objects as well as other objects not specifically enumerated are accomplished by a foldable soccer and hockey goal and equipment set constructed in accordance with the present invention. The soccer and hockey goal and equipment set of the present invention includes a goal structure comprising an inclined net holder with a net attached thereto. The inclined net holder comprises upper and lower horizontal net support members spaced apart substantially parallel to one another and each having first and second ends, and first and second vertical rods attached between the first and second ends, respectively, of the upper and lower horizontal net support members.

The inclined net holder is supported by first and second upright support members which are hingedly attached to the inclined net holder. The upright support members are approximately right-triangular in shape. In open position, the upright support members extend forward and down from the inclined net holder at a substantially 90 degree angle. The bottom legs of the support members rest on the playing surface and the front legs form an opening which serves as the soccer or hockey goal. The support members can be made from blow-molded plastic and are made to be hollow to allow filling with a ballasting material, such as sand or water, to provide stability to the goal when the goal is in use. Filler holes are provided for adding the ballasting material.

In closed position, the support members fold inwardly toward each other until they rest against the inclined net holder. Elongated members such as hockey sticks can then be placed through a pair of rungs on the outside of each support member with each hockey stick being situated through one of the rungs on each support member. The hockey sticks situated through the rungs maintain the upright support members in a folded position and prevent the support members from swinging open while the soccer and hockey goal and equipment set is being transported and stored. The curve of the blades of the hockey sticks prevent the hockey sticks from sliding out from the rungs. The soccer ball and the hockey ball can be placed in the net, and are held in place by the closed support members. Thus, all of the equipment can be carried conveniently in one self-contained package. A handle on top of the inclined net holder provides for ease of carrying.

These and other details, objects and advantages of the invention will become apparent as the following description of the present preferred embodiment thereof proceeds.

BRIEF DESCRIPTION OF THE DRAWINGS

The preferred embodiment of the present invention will be described in greater detail with reference to the accompanying drawings, wherein like members bear like reference numerals and wherein.

DETAILED DESCRIPTION OF A PREFERRED EMBODIMENT

Figure 1:
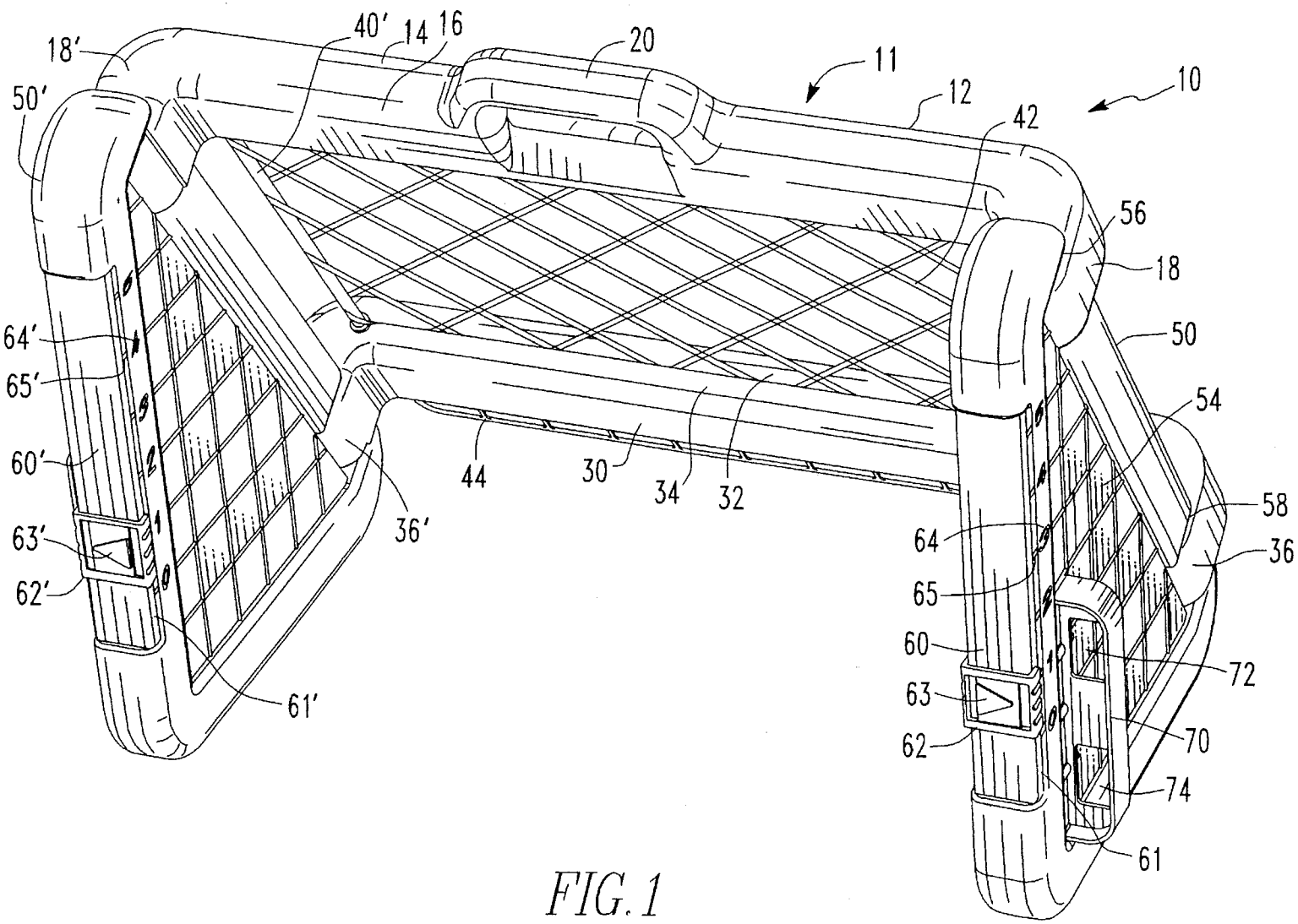
FIG. 1 is a perspective view of the soccer and hockey goal and equipment set of the present invention in an open position.
Figure 2:
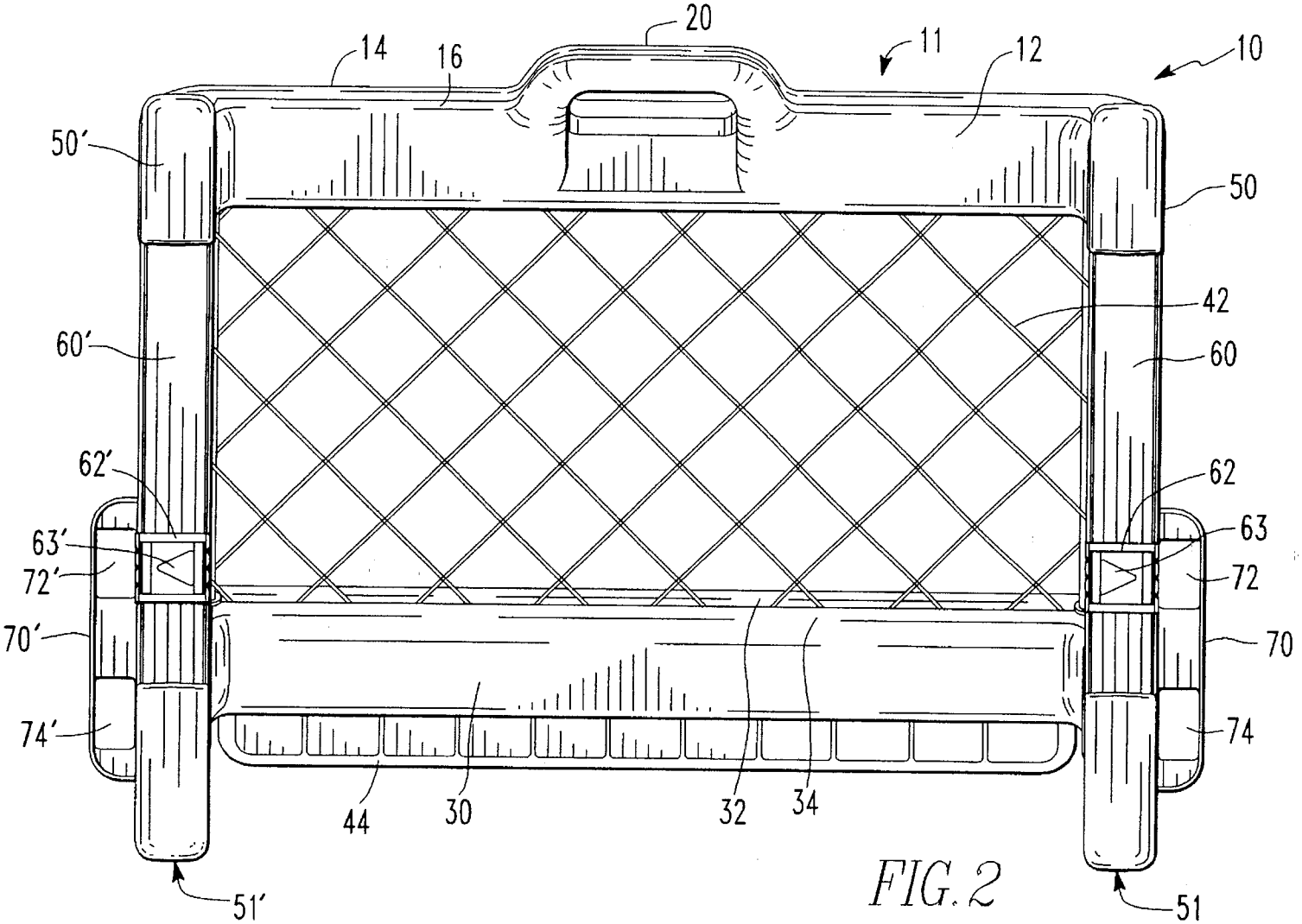
FIG. 2 is a front view of the soccer and hockey goal and equipment set of FIG. 1.
Figure 3:
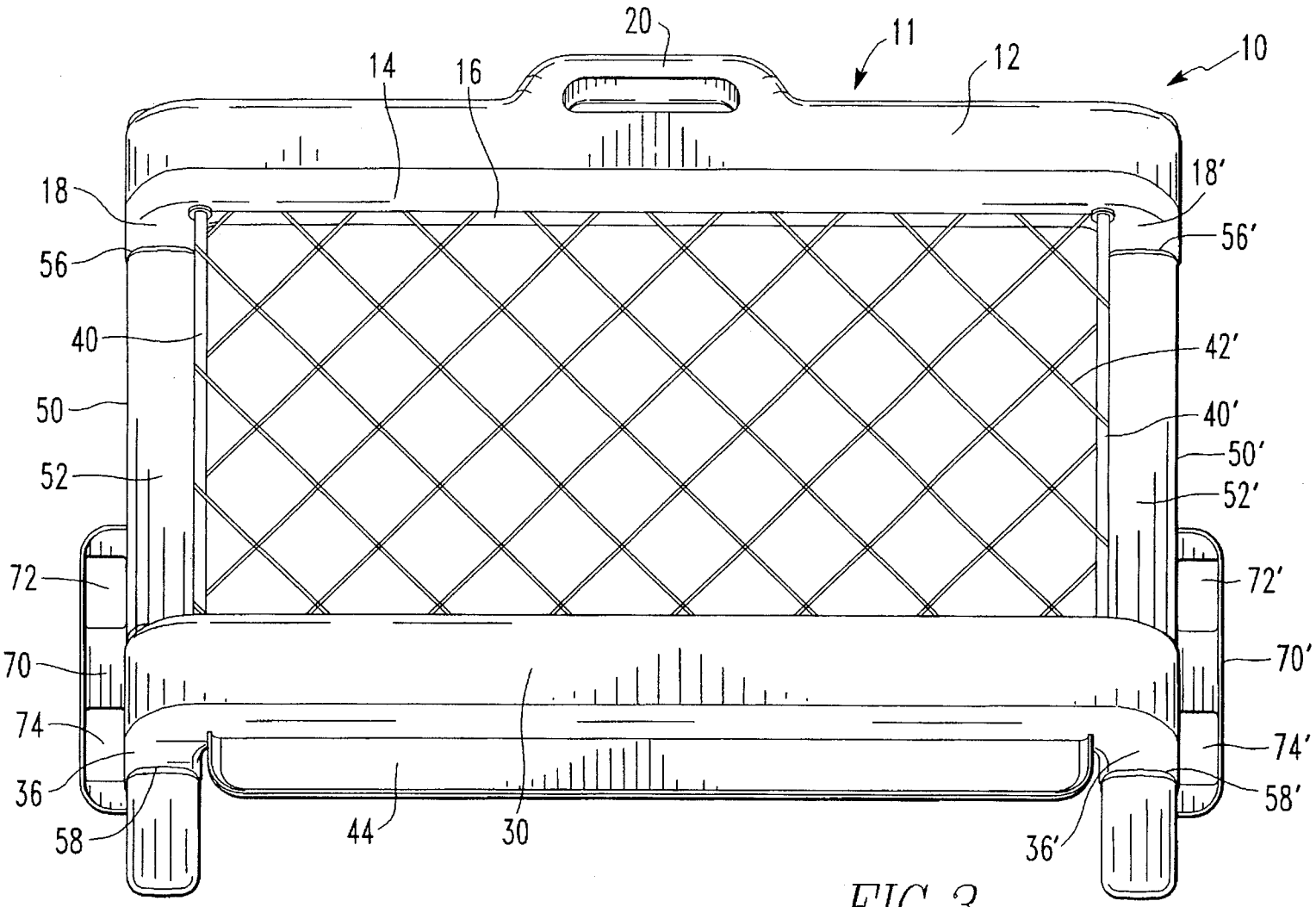
FIG. 3 is a back view of the soccer and hockey goal and equipment set of FIG. 1.
Figure 4:
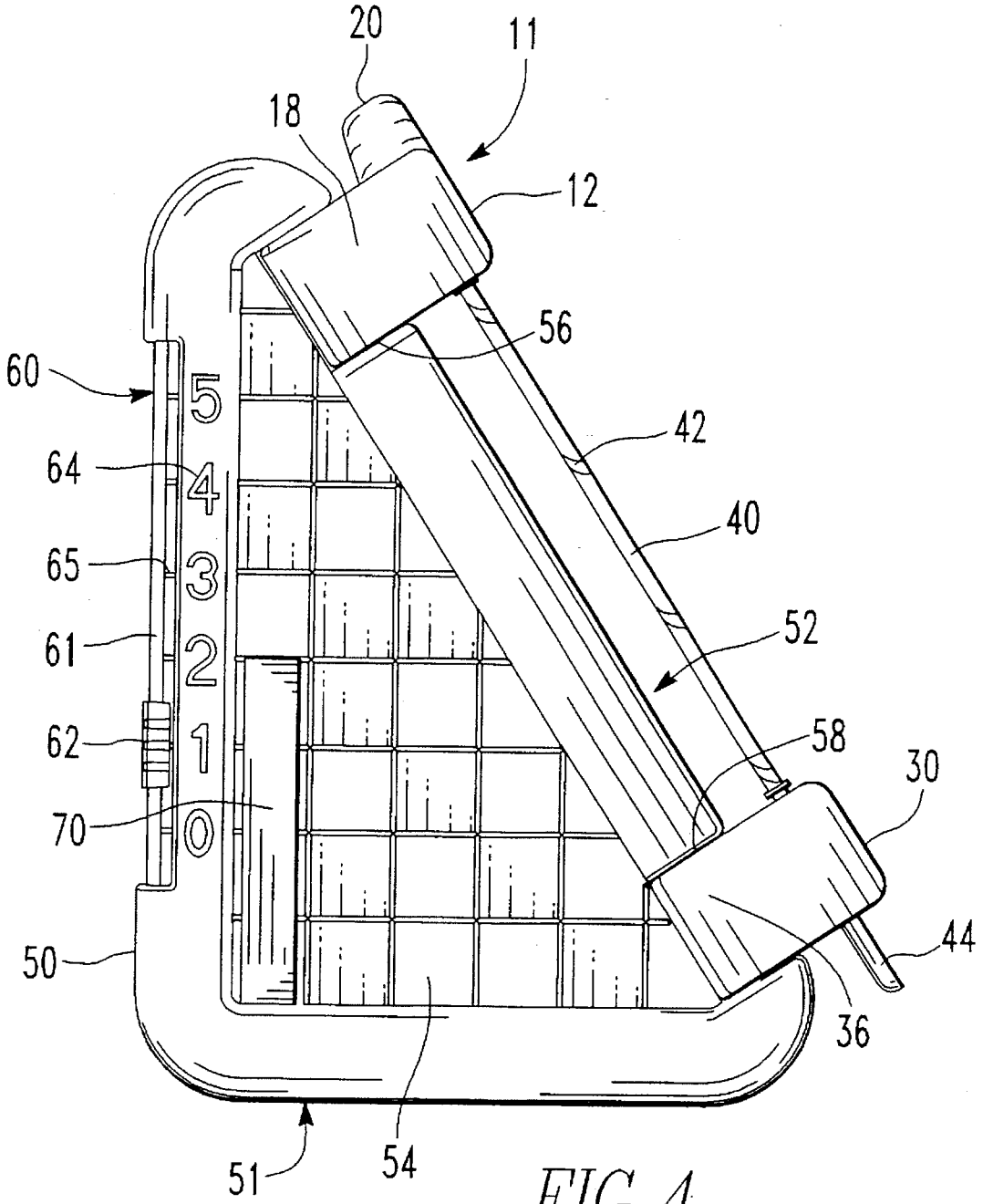
FIG. 4 is a right side view of the soccer and hockey goal and equipment set of FIG. 1.
Figure 5:
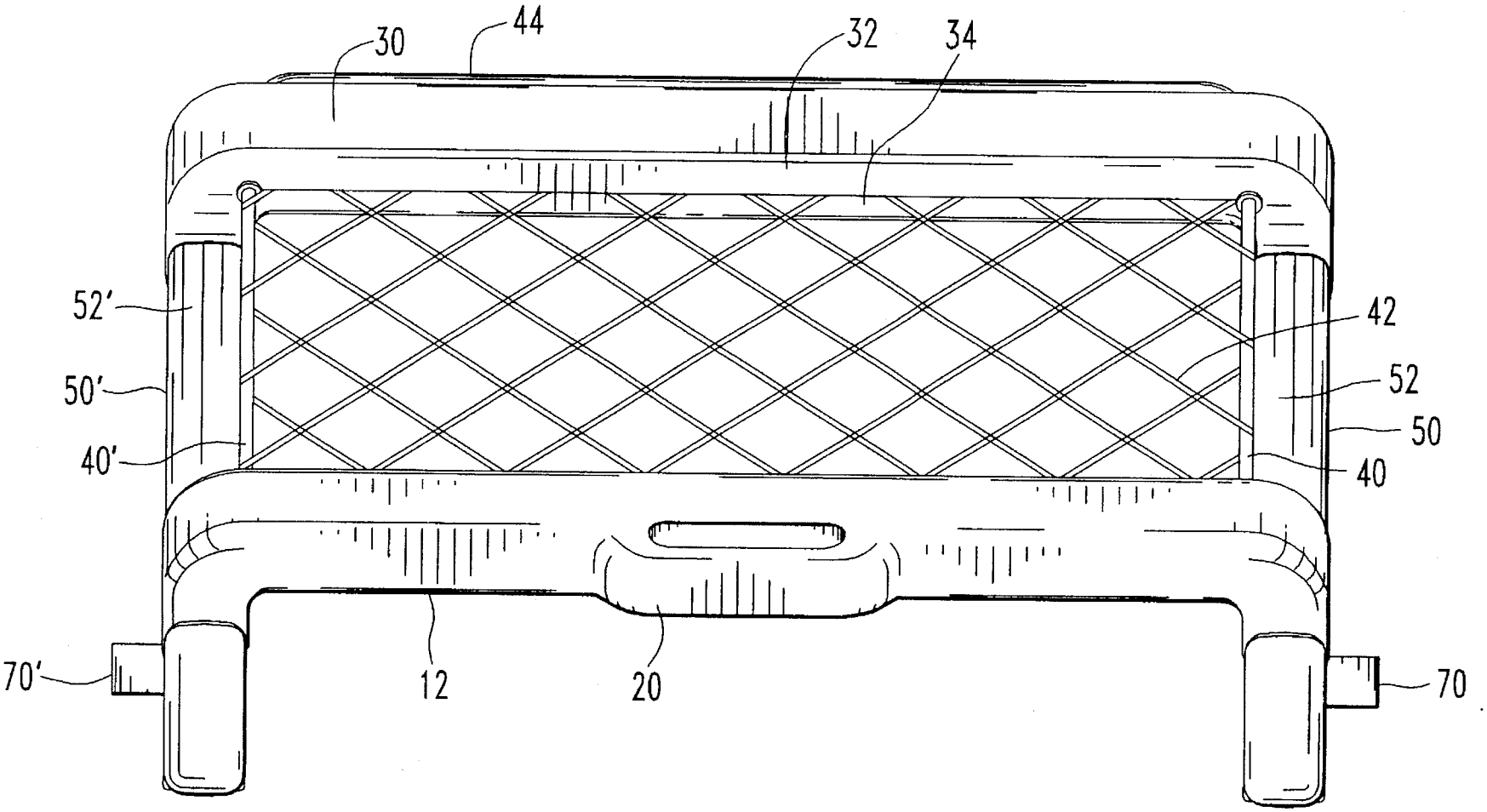
FIG. 5 is a top view of the soccer and hockey goal and equipment set of FIG. 1.
Figure 6:
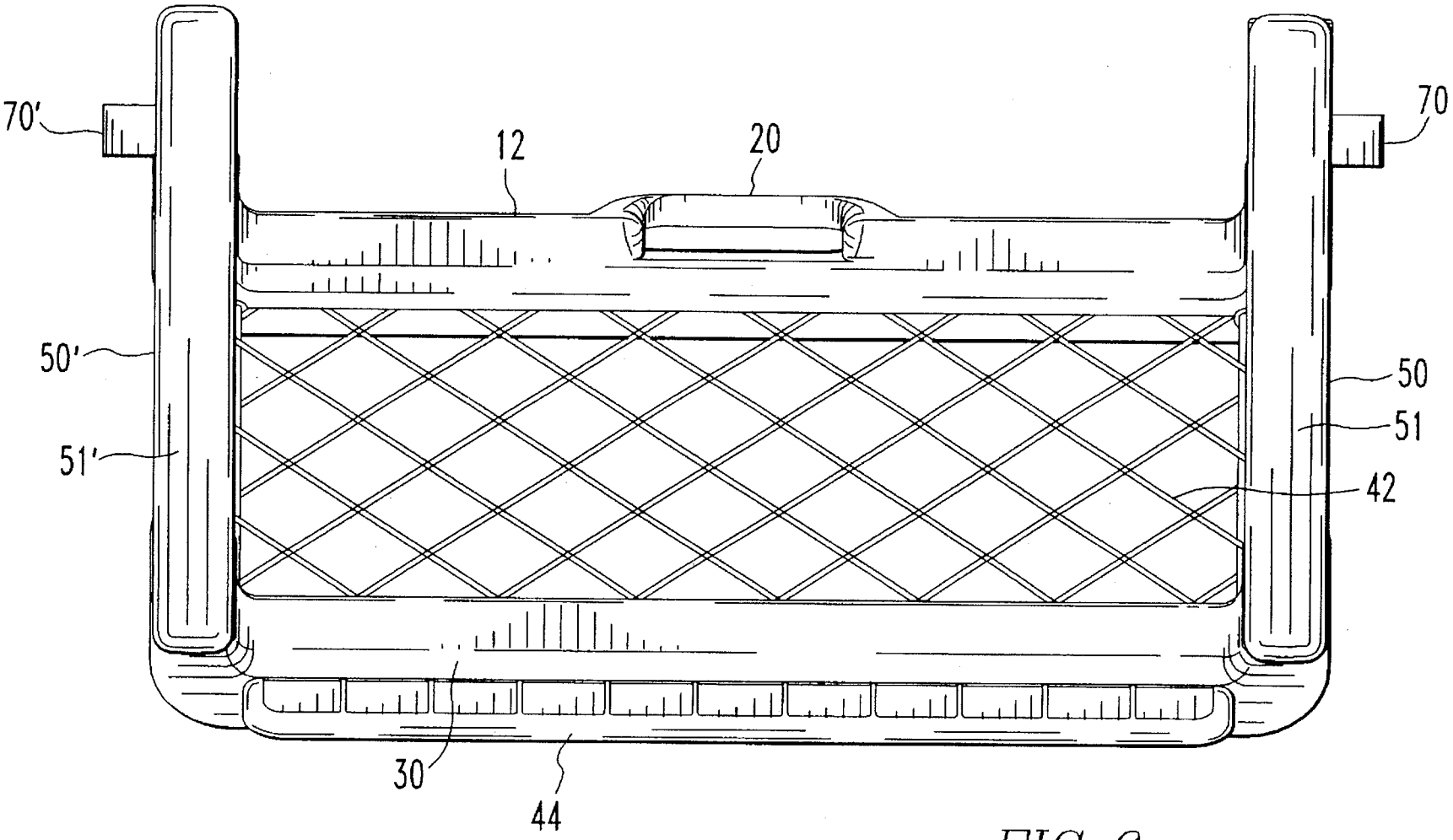
FIG. 6 is a bottom view of the soccer and hockey goal and equipment set of FIG. 1.
Figure 7:
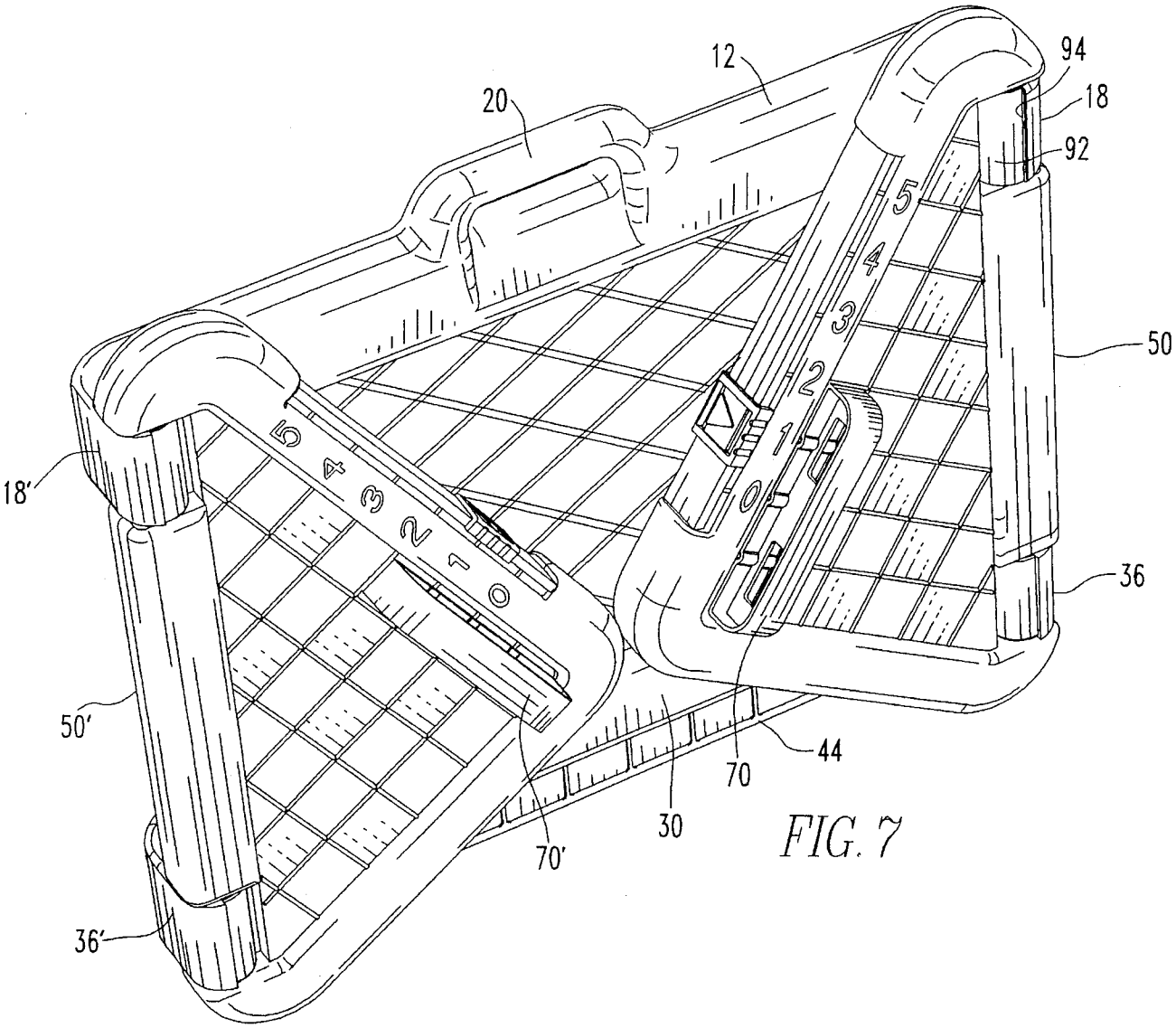
FIG. 7 is a perspective view of the soccer and hockey goal and equipment set of the present invention in a closed position.

Referring to the drawings wherein the showings are for purposes of illustrating a present preferred embodiment of the invention only and not for purpose of limiting same, the Figures show a soccer and hockey goal and equipment set in accordance with an embodiment of the present invention which includes a goal 10 having an inclined net holder 11. Inclined net holder 11 comprises upper horizontal net support 12, lower horizontal net support 30, and vertical side rods 40 and 40'. Upper horizontal net support 12 is made up of two pieces, upper rear support 14 and upper front support 16, which are preferably made of injection molded plastic, although other known materials may be substituted, and fastened together, as with screws. Upper horizontal net support 12 curves toward the front at each end to form upper hinge supports 18 and 18', respectively. Handle 20 is molded into upper horizontal net support 30 for carrying goal 10.

Figure 14:
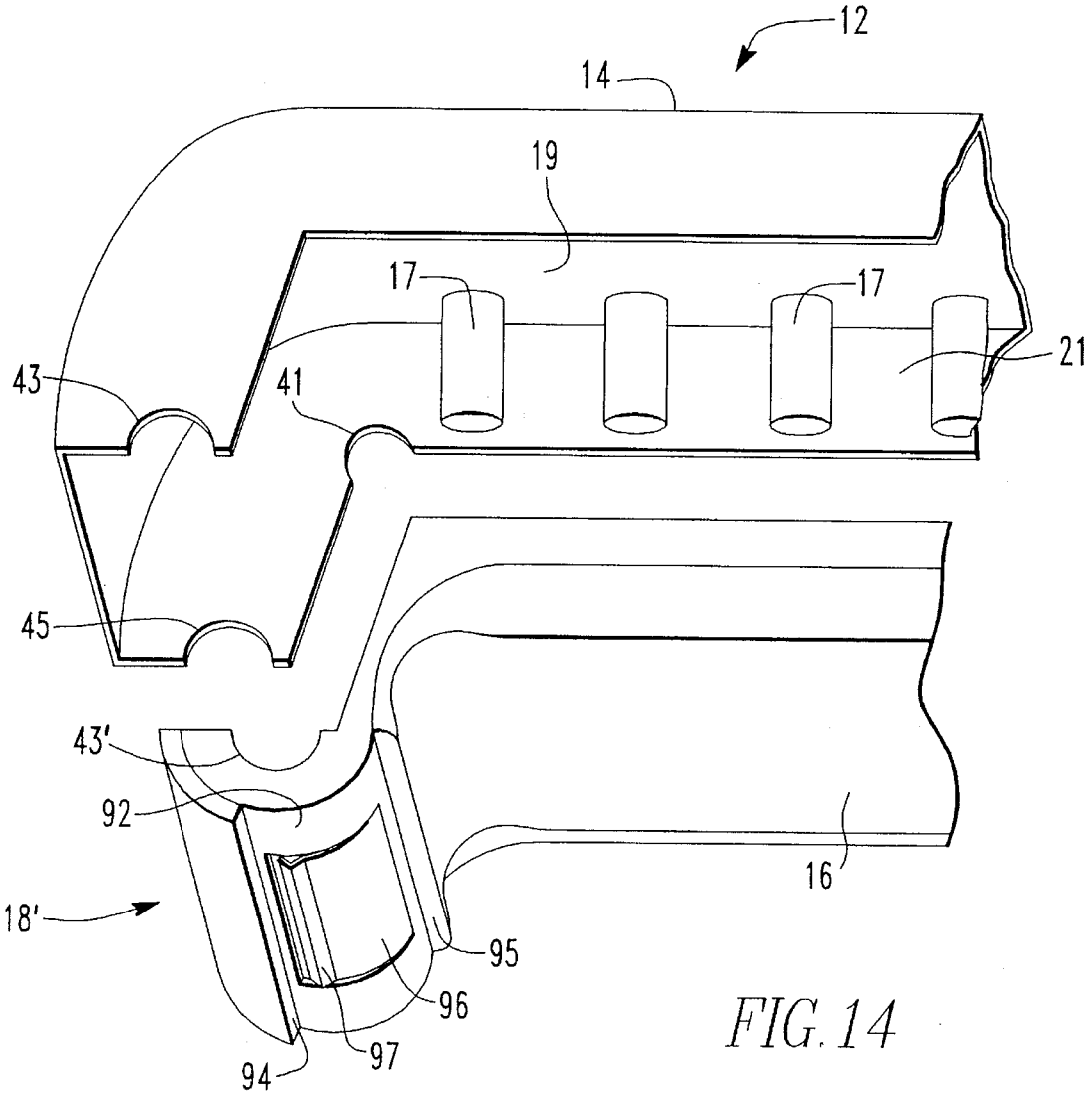
FIG. 14 is a perspective exploded view of a portion of the soccer and hockey goal and equipment set of FIG. 1.

Lower horizontal net support 30 is also made up of two pieces, namely, lower rear support 32 and lower front support 34, which are preferably made of injection molded plastic and are also fastened together, as with screws. Lower horizontal net support 30 curves toward the front at each end to form lower hinge supports 36 and 36', respectively. Right and left vertical side rods 40 and 40', respectively, are disposed between upper horizontal net support 12 and lower horizontal net support 30 substantially near the opposite ends of upper horizontal net support 12 and lower horizontal net support 30. In this embodiment, vertical side rods 40 and 40' are sandwiched between upper rear support 14 and upper front support 16 at the top and in between lower rear support 32 and lower front support 34 at the bottom and are thus firmly held in place. As shown in FIG. 14, rear rod-receiving notch 41 formed in upper rear support 14 mates with front rod-receiving notch (not shown) formed in upper front support 16 to receive vertical side rod 40'. The skilled artisan will appreciate that rod-receiving notches (not shown) of similar configuration are formed in the opposite end of upper horizontal net support 12 and in both ends of lower horizontal net support 30 to receive vertical side rods 40 and 40'. Other methods of attaching vertical side rods 40 and 40' to upper horizontal net support 12 and lower horizontal net support 30 are within the ordinary skill in the art.

Net 42 is attached to inclined net holder 11 by being sandwiched between upper rear support 14 and upper front support 16 at the top and between lower rear support 32 and lower front support 34 at the bottom, and on the sides by looping the strands of net 42 around vertical side rods 40 and 40'. On the interior of upper rear and front supports 14 and 16 and of lower rear and front supports 32 and 34 are a plurality of net posts 17 (FIG. 14). Shown in FIG. 14 is a perspective exploded view of one end of upper horizontal net support member 12 and hinge support 18'. As shown in FIG. 14, net posts 17 extend from back interior face 19 of upper rear support 14 toward upper front support 16 in a row parallel to lower interior face 21 of upper rear support 14 and in close proximity thereto. The strands of net 42 are looped over net posts 17. Similar net posts (not shown) extend into the interior of upper front support 16. Net posts 17 and the net posts (not shown) extending into the interior of upper front support 16 are of sufficient length such that net posts 17 and the net posts (not shown) extending into the interior of upper front support 16 meet when upper rear support 14 and upper front support 16 are attached together, thus preventing net 42 from slipping over net posts 17 and out from between upper rear support 14 and upper front support 16. The skilled artisan will appreciate that similarly configured net posts (not shown) are formed on the interiors of lower rear support 32 and lower front support 34 for retaining net 42 at the bottom.

Returning to FIGS. 1–12, net 42 is attached loosely so as not to rebound a ball which enters it, yet must be taut enough to maintain objects in place when goal 10 is in a closed position, as described below. Rail 44 is attached below lower horizontal net support 30 to prevent a hockey ball 102 or other small balls from going under the inclined net holder 11.

Vertical side supports 50 and 50', respectively, support inclined net holder 11 in its inclined position from top/front to bottom/rear at approximately 57 degrees from the playing surface when goal 10 is in an open position (FIGS. 1–6). Vertical side supports 50 and 50' are preferably blow-molded upright supports of roughly right-triangular shape, and in an open position extend forward and down from the inclined net holder at a substantially 90 degree angle. Of course, other shapes may also be utilized for vertical side supports 50 and 50' and are within the scope of the invention. Legs 51 and 51' of vertical side supports 50 and 50', respectively, rest on the playing surface. Legs 60 and 60' of vertical side supports 50 and 50', respectively, face forward and define the sides of the opening which serves as the soccer or hockey goal. Legs 52 and 52' of vertical side supports 50 and 50', respectively, are attached to inclined net holder 11 via upper hinges 56 and 56', respectively, and lower hinges 58 and 58', respectively. Upper hinges 56 and 56' engage upper hinge supports 18 and 18', respectively, and lower hinges 58 and 58' engage lower hinge supports 36 and 36', respectively.

Figure 13:
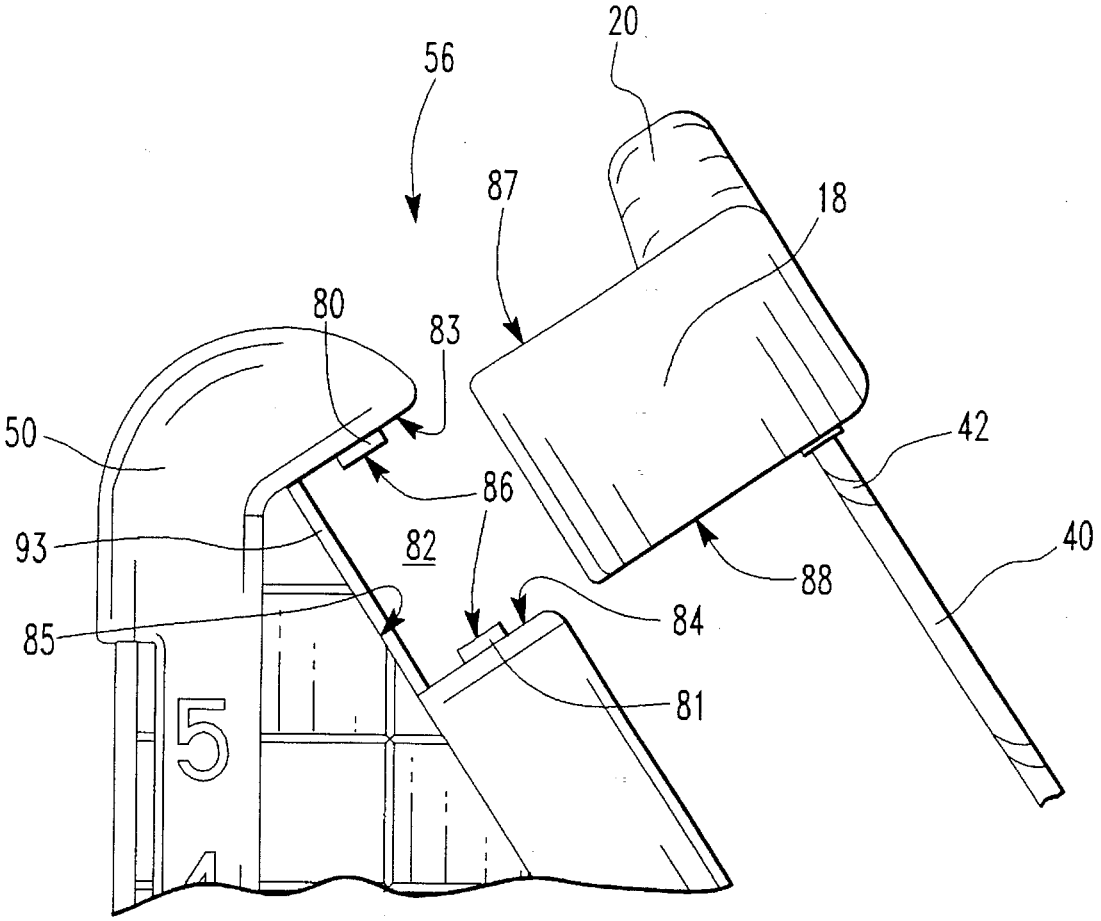
FIG. 13 is a sectional exploded view of a portion of the soccer and hockey goal and equipment set of FIG. 1.

Referring now to FIG. 13, upper hinge 56 will be described. The skilled artisan will appreciate that upper hinge 56' and lower hinges 58 and 58' are of the same configuration as upper hinge 56 and, therefore, the description for upper hinge 56 also describes upper hinge 56' and lower hinges 58 and 58'. Upper pin 80 and lower pin 81 are molded into upper surface 83 and lower surface 84, respectively, of hinge indentation 82 formed in upright support member 50. Upper and lower pins 80 and 81 fit into upper and lower pin-receiving holes (not shown), respectively, formed in upper and lower hinge support surfaces 87 and 88, respectively, of upper hinge support 18. FIG. 14 shows a perspective exploded view of hinge support 18', and shows upper rear pin-receiving notch 43 formed in upper rear support member 14 which mates with upper front pin-receiving notch 43' formed in upper front support member 16 to form a hole for receiving an upper pin (not shown), and lower rear pin-receiving notch 45 formed in upper rear support member 14 which mates with lower front pin-receiving notch (not shown) to form a hole for receiving a lower pin (not shown). The skilled artisan will appreciate that similarly configured pin-receiving holes are similarly formed in upper hinge support 18 and lower hinge supports 36 and 36'.

Returning to FIG. 13, goal 10 is assembled by sliding hinge support 18, preferably made of a slightly flexible plastic material, as described above, between upper and lower pins 80 and 81. Hinge support 18 and upper and lower surfaces 83 and 84, respectively, deflect slightly to allow hinge support 18 to fit between upper and lower pins 80 and 81 and snap into place with upper and lower pin-receiving holes (not shown) formed in upper and lower surfaces 87 and 88 receiving upper and lower pins 80 and 81, respectively. To facilitate assembly, pin ends 86 may be beveled and/or sloped so that hinge support 18 may more easily ride over upper and lower pins 80 and 81. Other hinging mechanisms are known in the art and are within the scope of the invention.

To prevent vertical side support 50 from swinging past the open and closed positions, detent face 92 is cut into hinge support 18. Referring to FIG. 13, a rib 93 is attached to vertical side support 50 on face 85 between upper surface 83 and lower surface 84 of hinge indentation 82. In the open position, rib 93 abuts detent stop 94 (FIGS. 7 and 14), preventing vertical side support 50 from swinging past the open position. In the closed position, rib 93 abuts detent stop 95. Referring to FIG. 14, detent tab 96 with tab ridge 97 is formed in detent face 92. As vertical side support 50 is moved from its closed position to its open position, rib 93 moves over detent tab 96 and tab ridge 97. As rib 93 moves over tab ridge 97, tab 96 and tab ridge 97 are forced down to allow rib 93 to move over tab ridge 97 and into the open position with rib 93 abutting detent stop 94, at which point tab 96 springs back into place imposing tab ridge 97 against rib 93, thus holding upright support member 50 in place. To close vertical side support 50, vertical side support 50 is pushed with enough force for rib 93 to push tab ridge 97 and tab 96 down to allow rib 93 to pass over them. Preferably tab 96 is constructed from material that has sufficient stiffness to retain vertical side support 50 in place, but enough flexibility and resilience to allow the proper amount of pressure to force tab 96 down and to allow tab 96 to spring back.

Vertical side supports 50 and 50' are preferably made of blow-molded plastic such that they are substantially hollow and watertight. Filler caps 70 and 70' are inserted into filler holes (not shown) in vertical side supports 50 and 50'. Ballast such as water or sand can be inserted into vertical side supports 50 and 50' to increase the weight of goal 10 and to stabilize goal 10 during play. After play, filler caps 70 and 70' can be removed and the ballast material can be emptied through the filler holes (not shown) to facilitate transportation and storage of goal 10.

Vertical side supports 50 and 50' can be molded to include various designs, numbers or other features. In the present embodiment, legs 60 and 60' of vertical side supports 50 and 50' are molded with flanges 61 and 61', respectively. Score tabs 62 and 62' with arrows 63 and 63' can be snapped onto flanges 61 and 61', respectively, and will be retained thereon while being able to slide up and down to mark different scores. Numbers 64 and 64' are molded adjacent to flanges 61 and 61' for arrows 63 and 63', respectively, to point to and raised ridges 65 and 65' on flanges 61 and 61' retain score tabs 62 and 62', respectively, in position pointing to the appropriate score, while allowing score tabs 62 and 62' to be moved easily to another position. Faces 54 and 54' of vertical side supports 50 and 50', respectively, can be molded with any desired design. Shown in FIGS. 1, 4, and 7–9 is a simulated net design.

Figure 8:
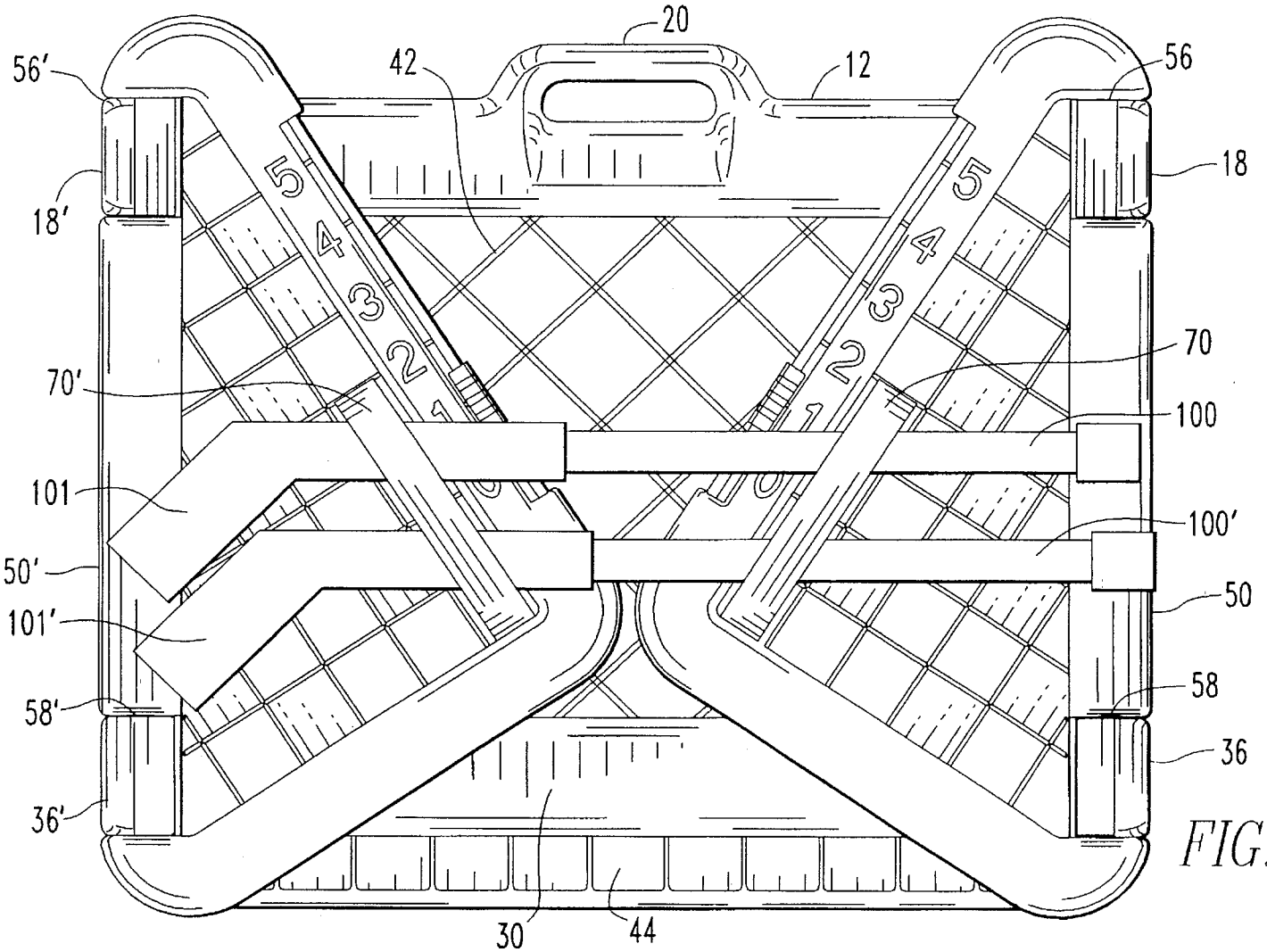
FIG. 8 is a front view of the soccer and hockey goal and equipment set of FIG. 7.
Figure 9:
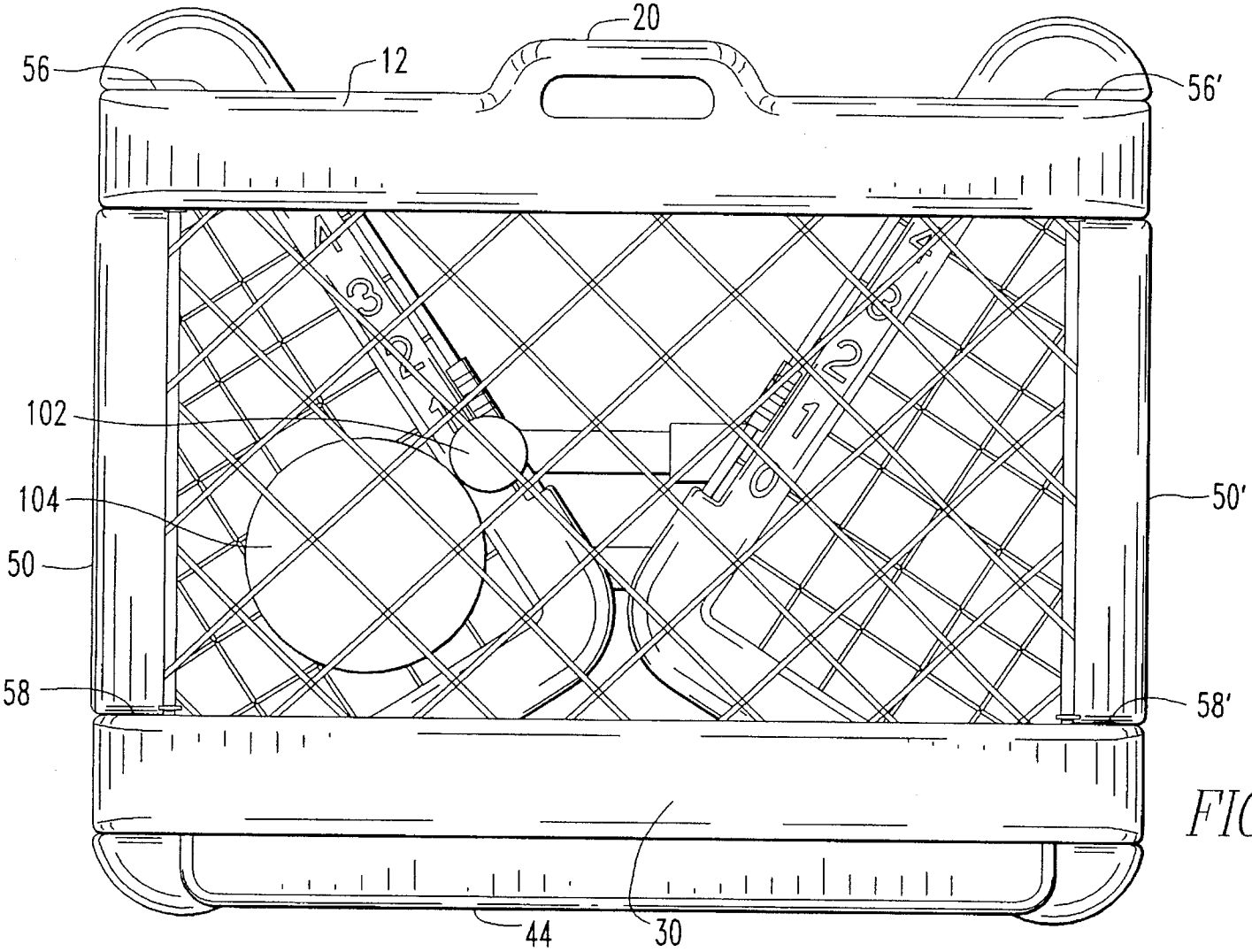
FIG. 9 is a back view of the soccer and hockey goal and equipment set of FIG. 7.
Figure 10:
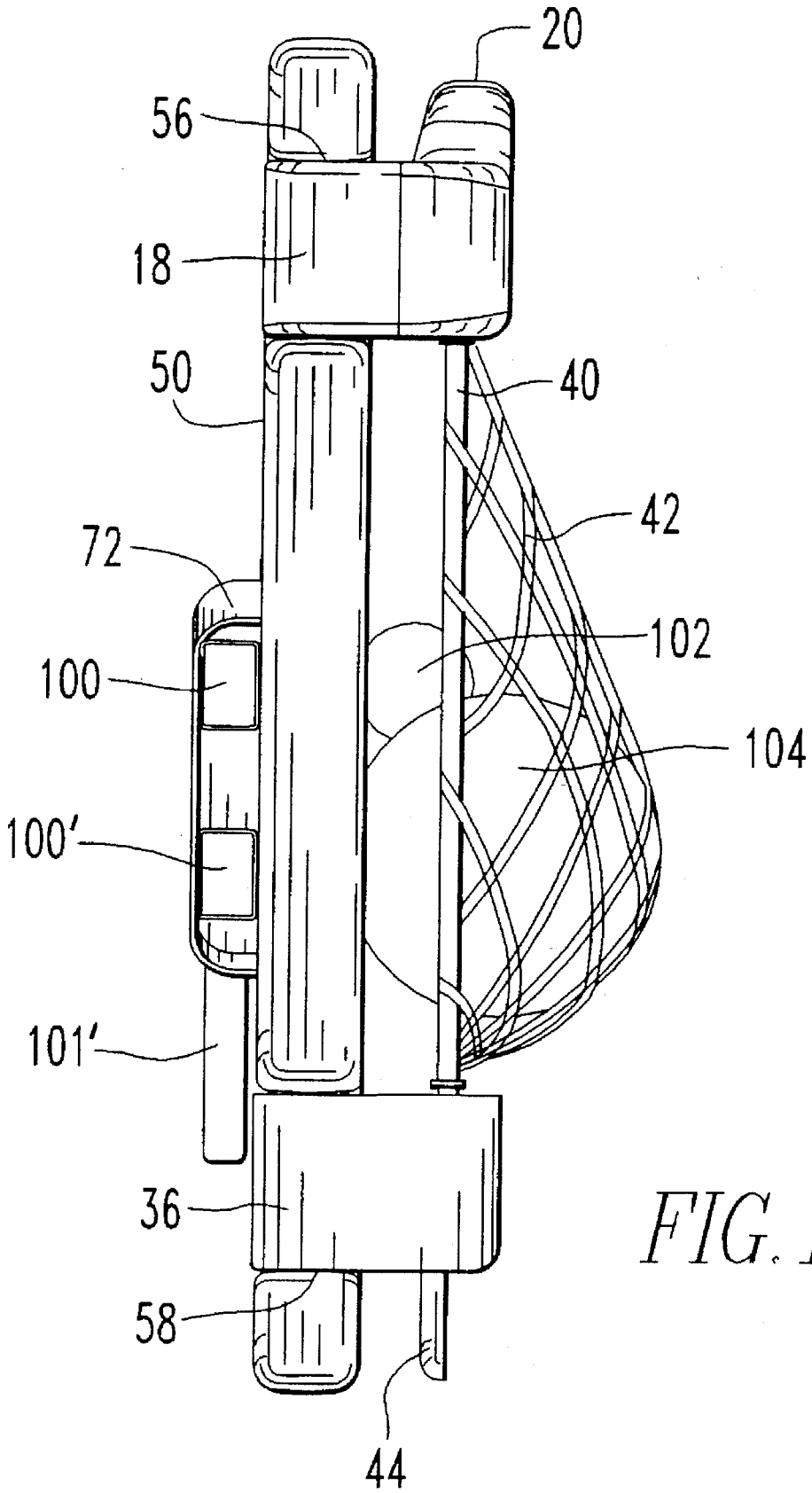
FIG. 10 is a right side view of the soccer and hockey goal and equipment set of FIG. 7.
Figure 11:
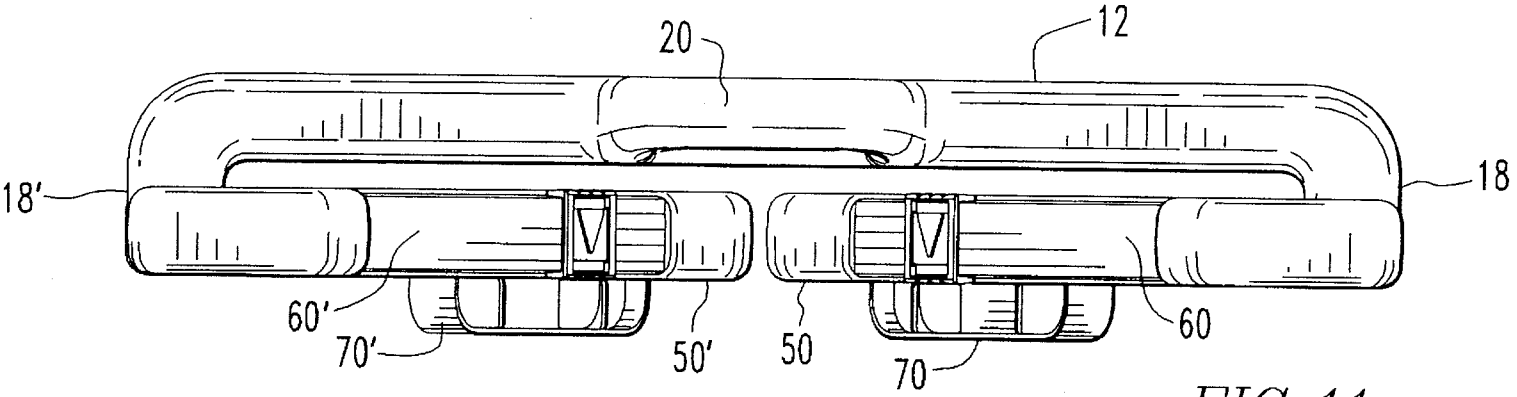
FIG. 11 is a top view of the soccer and hockey goal and equipment set of FIG. 7.
Figure 12:
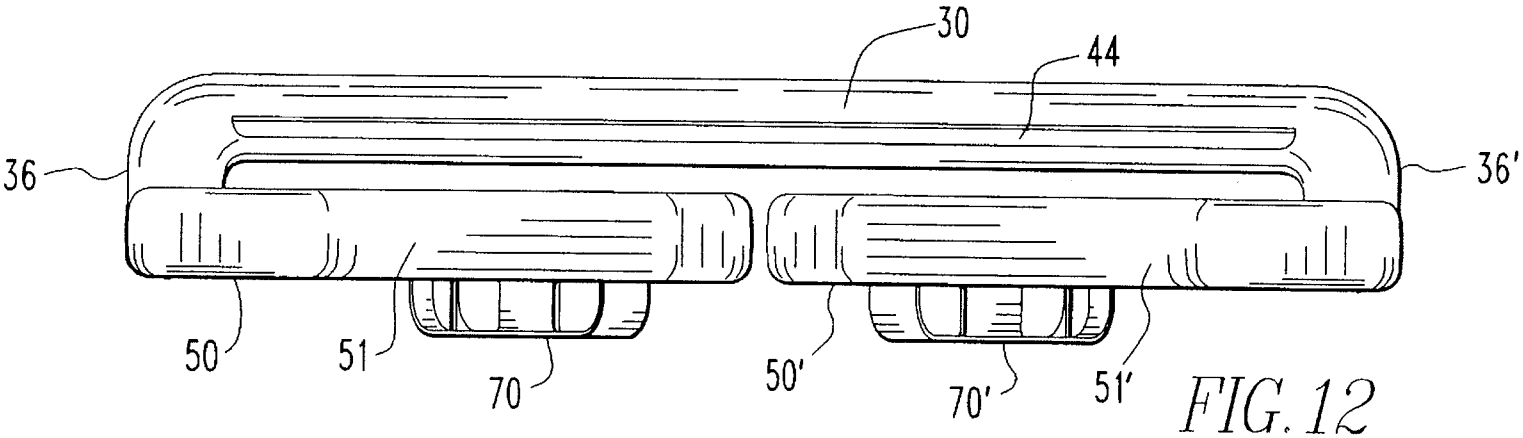
FIG. 12 is a bottom view of the soccer and hockey goal and equipment set of FIG. 7.

In the present embodiment, filler caps 70 and 70' are provided with upper rungs 72 and 72' and lower rungs 74 and 74', respectively. Of course, rungs 72, 72', 74 and 74' can be formed in vertical side supports 50 and 50' independently of filler caps 70 and 70'. When goal 10 is in the closed position (FIGS. 7–12), elongated members, such as hockey sticks 100 and 100' (FIGS. 8–10), can be inserted through rungs 72, 72', 74 and 74' to retain vertical side supports 50 and 50' folded in a position resting against inclined net holder 11. As shown in FIGS. 8–10, an optimal placement of hockey sticks 100 and 100' is for hockey stick 100 to be inserted through upper rung 72 and the opposite upper rung 72' and for hockey stick 100' to be inserted through lower rung 74 and the opposite lower rung 74'. The angles of blades 101 and 101' of hockey sticks 100 and 100' prevent hockey sticks 100 and 100' from sliding completely through rungs 72, 72', 74 and 74'. Hockey ball 102 and soccer ball 104 can be sandwiched between net 42 and closed vertical side supports 50 and 50' without falling out. Thus, goal 10, hockey sticks 100 and 100', hockey ball 102 and soccer ball 104 can be carried easily as one unit.

To use the present invention, the player can transport goal 10, hockey sticks 100 and 100', hockey ball 102 and soccer ball 104 as a unit in its closed position to the playing site using handle 20. To open goal 10, hockey sticks 100 and 100' are removed from rungs 72, 72', 74 and 74'. Vertical side supports 50 and 50' are swung from the closed position resting against inclined net holder 11 to open position wherein vertical side supports 50 and 50' form right angles to inclined net holder 11. Moving vertical side supports 50 and 50' to the open position allows access to hockey ball 102 and soccer ball 104. Goal 10 can then be placed in the desired location on the playing surface. To provide further stability, filler caps 70 and 70' can be removed and vertical side supports 50 and 50' can be filled with water, sand or other ballasting material. Filler caps 70 and 70' should be replaced while goal 10 is in use so that ballasting material does not pour out should goal 10 be knocked over in the course of play. The player can then use goal 10, and either hockey sticks 100 and 100' and hockey ball 102 or soccer ball 104, to play hockey or soccer. Other sports utilizing such a goal can also be played.

When play is finished, the player can remove filler caps 70 and 70' and tilt or lift goal 10 to empty ballasting material from vertical side supports 50 and 50'. Filler caps 70 and 70' are then replaced. Hockey ball 102 and soccer ball 104 are placed in net 42, and vertical side supports 50 and 50' are then swung to the closed position, entrapping hockey ball 102 and soccer ball 104 between net 42 and vertical side supports 50 and 50'. Hockey sticks 100 and 100' are then slid through rungs 72, 72', 74 and 74' as described above. The entire unit—goal 10 hockey sticks 100 and 100' hockey ball 102 and soccer ball 104—can then be transported and stored easily because of its lightness and compactness.

Plastic parts which are disclosed as being blow molded or injection molded may be formed in any of a variety of methods known for forming plastic.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A soccer and hockey goal, comprising:

an inclined net holder;

a net attached to said inclined net holder;

first and second upright support members hingedly attached to said inclined net holder;

a first rung attached to said first upright support member and a second rung attached to said second upright support member for receiving an elongated member therethrough for holding said first and second upright support members in a folded position against said inclined net holder.

2. A soccer and hockey goal as described in claim 1 wherein said elongated member retains said first and second upright support members in said closed position for holding objects between said first and second upright support members and said net.

3. A soccer and hockey goal as claimed in claim 2, further comprising an elongated member for engaging said first and second rungs.

4. A soccer and hockey goal as claimed in claim 3 wherein said elongated member comprises a hockey stick.

5. A soccer and hockey goal as claimed in claim 4 wherein said first and second upright support members are hollow and have means for adding ballast to the interior of said first and second upright support members.

6. A soccer and hockey goal as claimed in claim 2, further comprising a third rung attached to said first upright support member and a fourth rung attached to said second upright support member for receiving a second elongated member therethrough for holding said first and second upright support members in a closed position against said inclined net holder.

7. A soccer and hockey goal as claimed in claim 6, further comprising a first elongated member for engaging said first and second rungs and a second elongated member for engaging said third and fourth rungs.

8. A soccer and hockey goal as claimed in claim 7 wherein said first and second elongated members comprise hockey sticks.

9. A soccer and hockey goal, comprising:

an inclined net holder, said net holder further comprising:

an upper horizontal net support member having first and second ends;

a lower horizontal net support member having first and second ends spaced from said upper horizontal net support member;

a first vertical net support member attached between said first end of said upper horizontal net support member and said first end of said lower horizontal net support member; and a second vertical net support member attached between said second end of said upper horizontal net support member and said second end of said lower horizontal net support member;

a net attached to said inclined net holder between said upper and lower horizontal net members and between said first and second vertical net support members;

a first upright support member hingedly attached to said first end of said upper horizontal net support member and said first end of said lower horizontal net support member, said first upright support member being movable between an open position and a closed position;

a second upright support member hingedly attached to said second end of said upper horizontal net support member and said second end of said lower horizontal net support member, said second upright support member being movable between an open position and a closed position;

a first rung attached to said first upright support member;

a second rung attached to said second upright support member for receiving an elongated member therethrough and through said first rung, said elongated member retaining said first and second upright support members in said closed position for holding objects between said first and second upright support members and said net.

10. A soccer and hockey goal as claimed in claim 9, further comprising an elongated member for engaging said first and second rungs.

11. A soccer and hockey goal as claimed in claim 10 wherein said elongated member comprises a hockey stick.

12. A soccer and hockey goal as claimed in claim 11 wherein said first and second upright support members are hollow and have means for adding ballast to the interior of said first and second upright support members.

13. A soccer and hockey goal as claimed in claim 9, further comprising a third rung attached to said first upright support member and a fourth rung attached to said second upright support member for receiving a second elongated member therethrough for holding said first and second upright support members in a closed position against said inclined net holder.

14. A soccer and hockey goal as claimed in claim 13, further comprising a first elongated member for engaging said first and second rungs and a second elongated member for engaging said third and fourth rungs.

15. A soccer and hockey goal as claimed in claim 14 wherein said first and second elongated members comprise hockey sticks.

* * * * *

UNITED STATES PATENT AND TRADEMARK OFFICE

CERTIFICATE OF CORRECTION

PATENT NO. : 5,496,040

DATED : March 5, 1996

INVENTOR(S) : James D. Amburgey

It is certified that error appears in the above-indentified patent and that said Letters Patent is hereby corrected as shown below:

Col. 1, line 25, after "No." insert --4,116,446--

Signed and Sealed this

Twenty-third Day of July, 1996

Bruce Lehman

*Attest:*

BRUCE LEHMAN

*Attesting Officer*

*Commissioner of Patents and Trademarks*